US009038430B2

(12) United States Patent
Schunn et al.

(10) Patent No.: US 9,038,430 B2
(45) Date of Patent: May 26, 2015

(54) CLUSTER ARM ARRANGEMENT FOR THE INTERMEDIATE ROLL SETS OF 18 HS ROLL STANDS

(75) Inventors: Konrad Schunn, Korschenbroich (DE); Lothar Zwingmann, Haan (DE); Holger Pulst, Mettmann (DE); Arnulf Wurm, Olpe (DE); Ruediger Holz, Neunkirchen (DE)

(73) Assignee: SMS SIEMAG AG, Duesseldorf (DE)

( * ) Notice: Subject to any disclaimer, the term of this patent is extended or adjusted under 35 U.S.C. 154(b) by 428 days.

(21) Appl. No.: 13/379,512

(22) PCT Filed: Jul. 6, 2010

(86) PCT No.: PCT/EP2010/004062

§ 371 (c)(1),
(2), (4) Date: Mar. 8, 2012

(87) PCT Pub. No.: WO2011/003561

PCT Pub. Date: Jan. 13, 2011

(65) Prior Publication Data

US 2012/0151982 A1 Jun. 21, 2012

(30) Foreign Application Priority Data

Jul. 7, 2009 (DE) ..... 10 2009 032 200
Dec. 28, 2009 (DE) ..... 10 2009 060 640

(51) Int. Cl.
*B21B 13/14* (2006.01)
*B21B 29/00* (2006.01)
(Continued)

(52) U.S. Cl.
CPC ..... *B21B 13/14* (2013.01); *B21B 13/142* (2013.01); *B21B 13/145* (2013.01); *B21B 13/147* (2013.01); *B21B 29/00* (2013.01); *B21B 31/02* (2013.01); *B21B 31/10* (2013.01);
(Continued)

(58) Field of Classification Search
CPC .... B21B 13/14; B21B 13/145; B21B 13/147; B21B 29/00; B21B 31/02; B21B 31/22; B21B 31/10; B21B 31/103; B21B 2269/14; B21B 2269/16
USPC ..... 72/224, 237–239
See application file for complete search history.

(56) References Cited

U.S. PATENT DOCUMENTS 3,718,026 A 2/1973 Gawlikowicz et al.
4,270,377 A * 6/1981 Verbickas et al. ..... 72/247
(Continued)

FOREIGN PATENT DOCUMENTS

DE 3325493 A 1/1985
JP 01154803 A 6/1989
RU 149499 U1 9/2014

*Primary Examiner* — Shelley Self
*Assistant Examiner* — Pradeep C Battula
(74) *Attorney, Agent, or Firm* — Andrew Wilford

(57) ABSTRACT

The invention relates to a cluster arm arrangement for the intermediate roll sets of 18 HS roll stands, wherein arranged between the chock at the operating side and the chock at the drive side are cluster arms which are pivotable laterally of the intermediate roll and in which the lateral backing rolls are integrated for support of the working rolls in the stand. In that case, arranged between the chock (1) and the cluster arm (2) is a pivot pin (3), which is fixedly connected with the cluster arm and about the axis of which the cluster arm (2) is pivotable, and a locking means for the cluster arm (2) as well as an abutment (6) with a restoring spring (6) are operatively arranged on the pivot pin (3) as a compact unit in the region between the cluster arm (2) and chock (1).

4 Claims, 1 Drawing Sheet

(51) Int. Cl.

| | |
|---|---|
| ***B21B 31/02*** | (2006.01) |
| ***B21B 31/10*** | (2006.01) |
| *B21B 13/02* | (2006.01) |

(52) U.S. Cl.

CPC ..... *B21B 31/103* (2013.01); *B21B 2013/025* (2013.01); *B21B 2013/028* (2013.01); *B21B 2203/06* (2013.01); *B21B 2269/04* (2013.01); *B21B 2269/06* (2013.01); *B21B 2269/14* (2013.01)

(56) References Cited

U.S. PATENT DOCUMENTS

| | | | | |
|---|---|---|---|---|
| 4,898,014 | A | 2/1990 | Giazburg et al. | |
| 5,142,896 | A * | 9/1992 | Berger et al. | 72/242.4 |
| 6,098,439 | A | 8/2000 | Lecrivain | |
| 6,209,377 | B1 * | 4/2001 | Shore et al. | 72/237 |
| 7,032,424 | B2 | 4/2006 | Schunn et al. | |
| 7,185,522 | B2 | 3/2007 | Turley | |
| 2006/0196243 | A1 | 9/2006 | LeViavant | |

* cited by examiner

CLUSTER ARM ARRANGEMENT FOR THE INTERMEDIATE ROLL SETS OF 18 HS ROLL STANDS

CROSS REFERENCE TO RELATED APPLICATIONS

This application is the US-national stage of PCT application PCT/EP2010/004062 filed 6 Jul. 2010, published 13 Jan. 2011 as WO2011/00356, and claiming the priority of German patent application 102009032200.0 itself filed 7 Jul. 2009 and German patent application 102009060640.8 itself filed 28 Dec. 2009.

FIELD OF THE INVENTION

The invention relates to a cluster arm arrangement for the intermediate roll sets of 18 horizontal-stabilization roll stands, wherein arranged between the chock at the operating side and the chock at the drive side are cluster arms which are pivotable laterally of the intermediate roll and in which the lateral backing rolls for support of the working rolls in the stand are integrated.

BACKGROUND OF THE INVENTION

In the case of the cassette mode of construction of the intermediate roll sets for 18 HS roll stands, pivotable cluster arms—in which the lateral backing rolls for support of the slender working rolls in the stand are integrated—are arranged between the chock at the operating side and the chock at the drive side to be pivotable laterally of the intermediate roll (inlet side and outlet side). The purpose of the backing rolls integrated in the cluster arms is to prevent warping of the working roll as well as to realize the horizontal offset (HS) of the working roll with respect to the intermediate roll with the help of the support bridge adjustment arranged therebehind.

In the case of a roll change, when with support bridge adjustment into a retracted setting the cluster arms 'are free', the cluster arms have to be brought into a defined position and be disposed centrally with respect to the stand and thus position the working rolls on the stand center.

In known constructions the pivot axle, which is fixedly connected with the cluster arm, is led completely through the chocks as far as the outer side thereof and fixed by retaining blocks, so that the axle can rotate in the chocks. Restoring of the cluster arms to the defined 'center position' is realized in that the pivot axle, which protrudes through the chock, of the cluster arm presses the cluster arm into the desired position by way of spring packets. This arrangement requires increased effort for the assembly and servicing of the intermediate roll set together with the cluster arms, since removal of the retaining blocks and the spring packets on each occasion of demounting and remounting the retaining blocks and spring packets, as well as setting of the spring packets for establishing the central position of the cluster arms, are necessary in the roll workshop.

In addition, in order to demount the cluster arm the two chocks have to be completely moved apart until the long pivot axle is free.

OBJECT OF THE INVENTION

The object of the invention is to create a cluster arm arrangement which substantially simplifies mounting and maintenance operations.

SUMMARY OF THE INVENTION

According to the invention this object is fulfilled by a cluster arm arrangement for the intermediate roll sets of 18 HS rolls stands, wherein arranged between the chock at the operating side and the chock at the drive side are cluster arms which are pivotable laterally of the intermediate roll and in which the lateral support rolls for supporting the working rolls in the stand are integrated, which arrangement is characterized in that a pivot pin, which is fixedly connected with the cluster arm and about the axis of which the cluster arm is pivotable, is arranged between the chock and the cluster arm and that a locking means for the cluster arm as well as an abutment with a restoring spring are operatively arranged on the pivot pin as a compact unit in the region between the cluster arm and chock.

In detail, it is then provided that the pivot pin fixedly connected with the cluster arm co-operates with a locking bar which serves as locking means and which is so constructed that when the locking bar pivotably fastened to the chock is pivoted in, the cluster arm is axially locked with respect to the chock, but nevertheless remains pivotable.

The pivotable locking bar is fixable in the closed state by a fixing screw.

After release of the fixing screw the pivotable locking bar can be pivoted out, wherein the cluster arm is freed so that the chock can be moved out axially.

Moreover, it is provided that an abutment member, which pivots in company with the cluster arm, is fastened to the outer collar of the pivot pin, wherein the pivot movement of the cluster arm outwardly is limited by the locking bar, against which the abutment member is then supported.

According to a further embodiment the pivot movement of the cluster arm in inward direction can be absorbed by a restoring spring, wherein when no forces act from outside on the cluster arm the restoring spring presses the cluster arm back until the abutment member bears against the locking bar.

In the new concept, the locking means of the cluster arms as well as the abutment with the restoring spring are arranged as a compact unit in the region between the cluster arm and chock and, in particular, at each of the two ends.

In that case, two pivot pins are fixedly mounted at the cluster arm instead of the long pivot axle of the cluster arm. This simplifies assembly and servicing operations, because in order to demount the cluster arms the chocks only have to be moved apart by a short stroke.

The pivot pin fixedly connected with the cluster arm is constructed so that when a locking bar pivotably fastened to the chock is pivoted in, the cluster arm is axially locked to the chock, but nevertheless remains pivotable.

BRIEF DESCRIPTION OF THE DRAWING

The invention shall be explained in the following with reference to the drawings, in which.

SPECIFIC DESCRIPTION OF THE INVENTION

Figure 1:
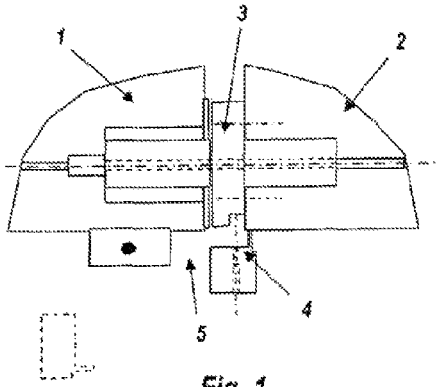
FIG. 1 illustrates locking of the cluster arm to the chock.
Figure 2:
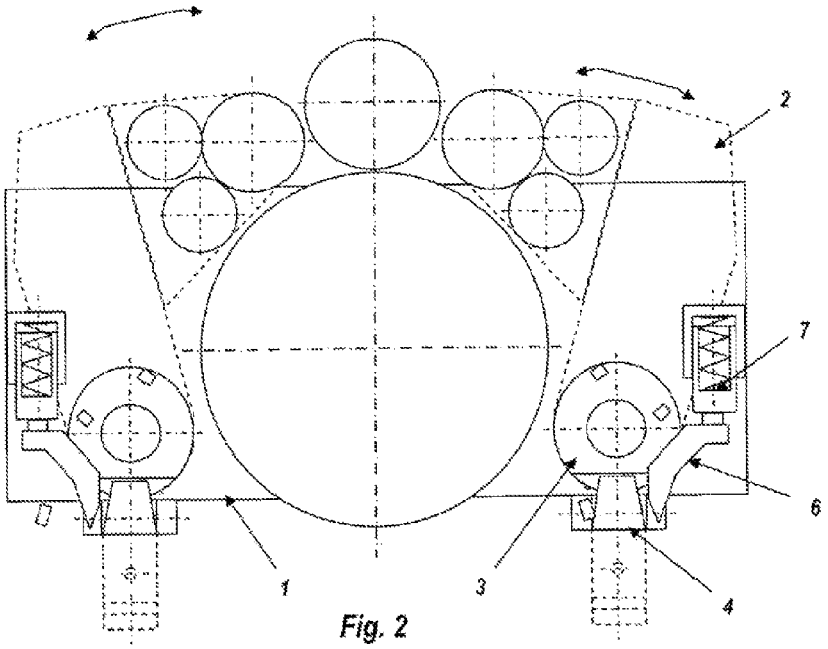
FIG. 2 illustrates the locking means and abutment with restoring spring.

The pivot pin 3 is arranged between the chock 1 and the cluster arm 2, the cluster arm 2 being pivotable about the axis of the pivot pin 3.

The pivot pin 3 fixedly connected with the cluster arm 2 is so constructed that when a locking bar 4 pivotably fastened to the chock 1 is pivoted in, the cluster arm 2 is axially locked to the chock 1, but nevertheless remains pivotable.

The pivotable locking bar 4 is fixed in the closed state by a fixing screw 5.

After release of the fixing screw 5 the pivotable locking bar 4 can be pivoted open and frees the cluster arm 2 so that the chock 1 can be moved out axially.

An abutment member 6 which pivots with the cluster arm 2 is fastened to the outer collar of the pivot pin 3. Pivoting of the cluster arm 2 outward is limited by the locking bar 4, against which the abutment member 6 is in that case supported. This position is that which the cluster arm 2 must adopt in the event of a roll change.

Pivoting of the cluster arm 2 inward is resisted by a restoring spring 7. If no forces act on the cluster arm 2 from the outside, the restoring spring 7 presses the cluster arm 2 back until the abutment member 6 bears against the locking bar 4.

The invention claimed is:

1. A cluster arm arrangement for an intermediate roll set of an 18 HS roll stand where between a chock at an operating side and a chock at the drive side there are respective cluster arms that are pivotable laterally of an intermediate roll and in which are integrated lateral backing rolls for support of working rolls in the stand the cluster arm arrangement comprising:

a respective pivot pin that is between each chock and the respective cluster arm, that is fixedly connected with the respective cluster arm, and that defines an axis about which the respective cluster arm is pivotable;

respective locking bars pivotal inward on the chocks for axially arresting the respective cluster arms relative to the respective chock while permitting the respective cluster arms to pivot about the respective pivot pins, and respective abutments and restoring springs operatively connected to each of the pivot pins as a compact unit in a region between the respective cluster arm and chock for limiting pivoting of the respective cluster arm, the abutments being fixed on outer collars of the respective pivot pins and braced outwardly against the locking bars for limiting pivoting of the respective cluster arms.

2. The cluster arm arrangement according to claim 1, wherein the pivotable locking bar is fixable in an inner closed state by a fixing screw.

3. The cluster arm arrangement according to claim 1, wherein after release of the fixing screw the respective pivotable locking bar can be pivoted out to free the respective cluster arm so that the chock can be moved out axially.

4. The cluster arm arrangement according to claim 1, wherein pivotal movement of the cluster arm in inward direction is absorbed by a respective restoring spring, wherein if no forces act from the outside on the cluster arm the respective restoring spring presses the cluster arm back until the respective abutment member bears against the respective locking bar.

* * * * *